US012721415B2

(12) United States Patent
Ahn et al.

(10) Patent No.: US 12,721,415 B2
(45) Date of Patent: Sep. 1, 2026

(54) HAIRDRYER

(71) Applicant: LG ELECTRONICS INC., Seoul (KR)

(72) Inventors: Kwangwoon Ahn, Seoul (KR); Goondong Park, Seoul (KR); Kyungseok Min, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 543 days.

(21) Appl. No.: 18/274,179

(22) PCT Filed: Jan. 25, 2022

(86) PCT No.: PCT/KR2022/001282
§ 371 (c)(1),
(2) Date: Jul. 25, 2023

(87) PCT Pub. No.: WO2022/164167
PCT Pub. Date: Aug. 4, 2022

(65) Prior Publication Data

US 2024/0090643 A1 Mar. 21, 2024

(30) Foreign Application Priority Data

Jan. 27, 2021 (KR) ..... 10-2021-0011458

(51) Int. Cl.
*A45D 20/12* (2006.01)
*A45D 20/42* (2006.01)
*F04D 29/66* (2006.01)

(52) U.S. Cl.
CPC ..... *A45D 20/12* (2013.01); *A45D 20/42* (2013.01); *F04D 29/66* (2013.01)

(58) Field of Classification Search
CPC ..... A45D 20/12; A45D 20/42; F04D 29/66; F04D 25/084; F04D 29/522; F04D 25/08; F04D 29/663
See application file for complete search history.

(56) References Cited

U.S. PATENT DOCUMENTS

2016/0235178 A1* 8/2016 Atkinson ..... F26B 21/003
2016/0338465 A1* 11/2016 Wilkinson ..... A45D 20/12

FOREIGN PATENT DOCUMENTS

CN 109156966 A * 1/2019 ..... A45D 20/10
KR 1020180124165 11/2018
KR 101965272 4/2019
KR 101978707 5/2019

OTHER PUBLICATIONS

Translation, CN-109156966-A (Year: 2019).*

* cited by examiner

*Primary Examiner* — Jessica Yuen
(74) *Attorney, Agent, or Firm* — LEE, HONG, DEGERMAN, KANG & WAIMEY

(57) ABSTRACT

A hairdryer is disclosed. The hairdryer according to an embodiment of the present invention comprises a body part and a handle part, wherein the body part includes a body extension part which extends into a gas flow channel, and the handle part includes: a handle case which forms at least a part of the appearance of the handle part, in which the gas flow channel is formed, and into which the body extension part is inserted; a fan unit which is provided in the gas flow channel to move gas; and a handle frame which is provided in the gas flow channel, is coupled to the fan unit, and is coupled to the body extension part to fix the fan unit.

22 Claims, 14 Drawing Sheets

【Fig.1】
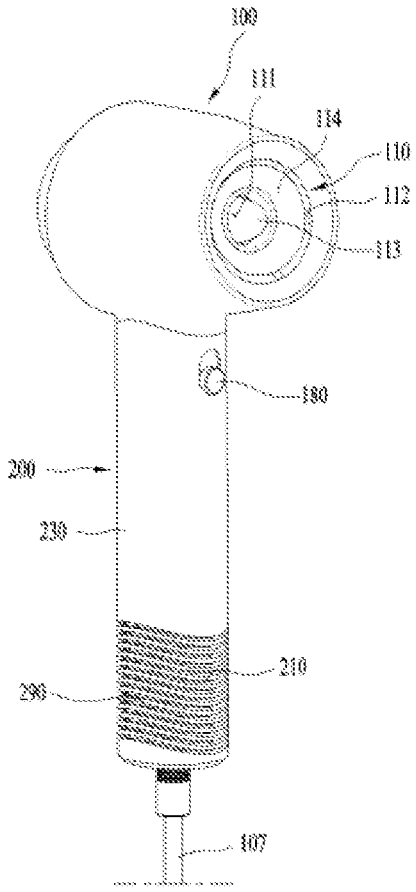

【Fig.2】
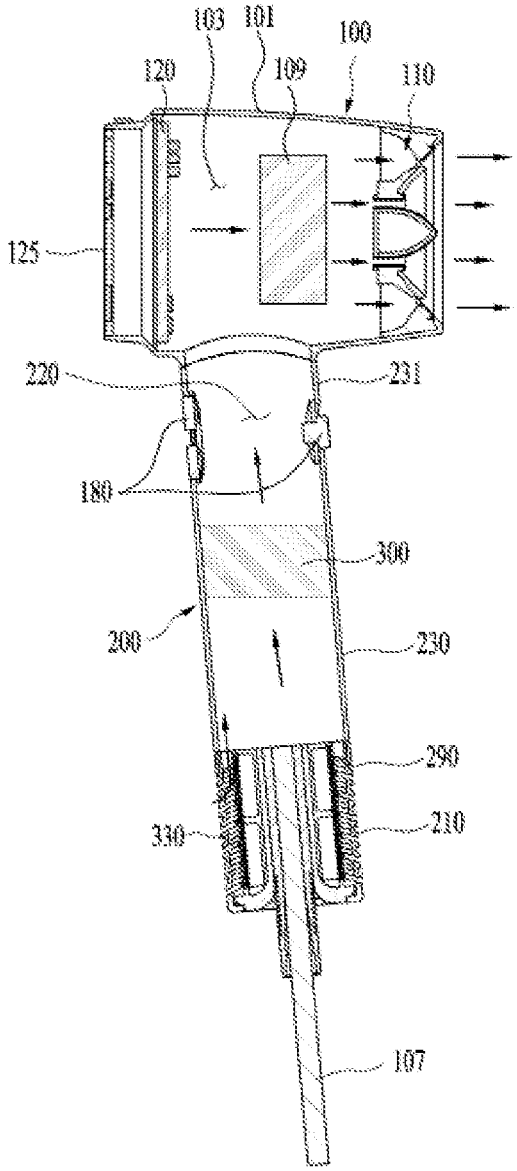

【Fig.3】
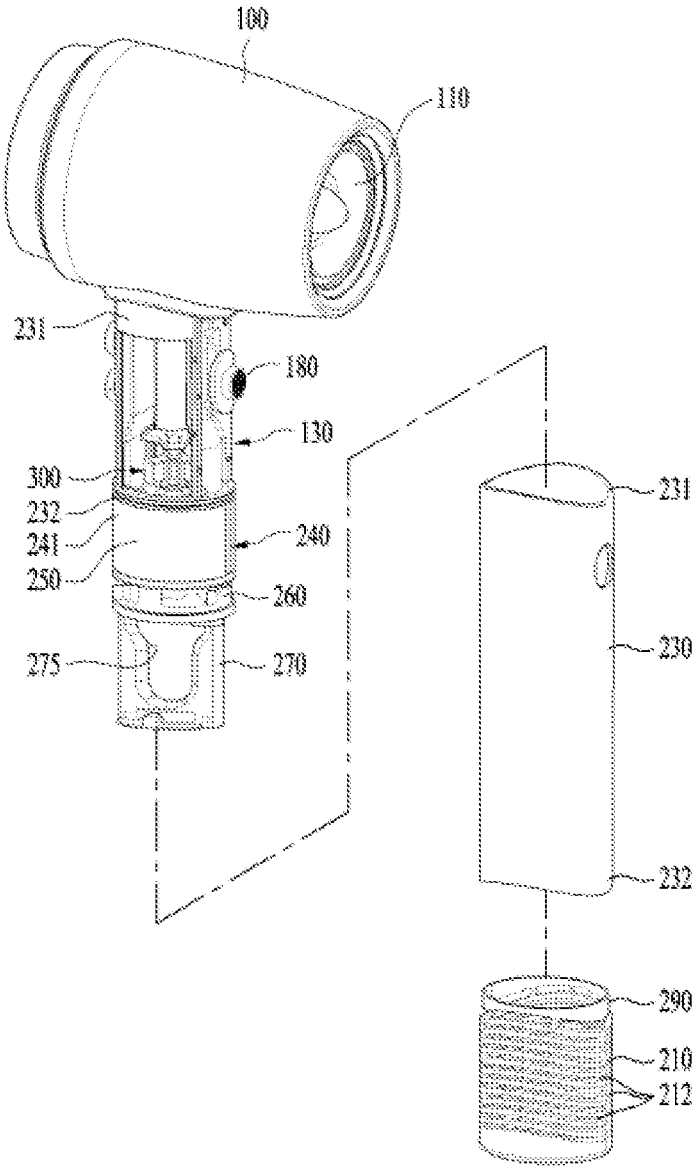

【Fig.4】
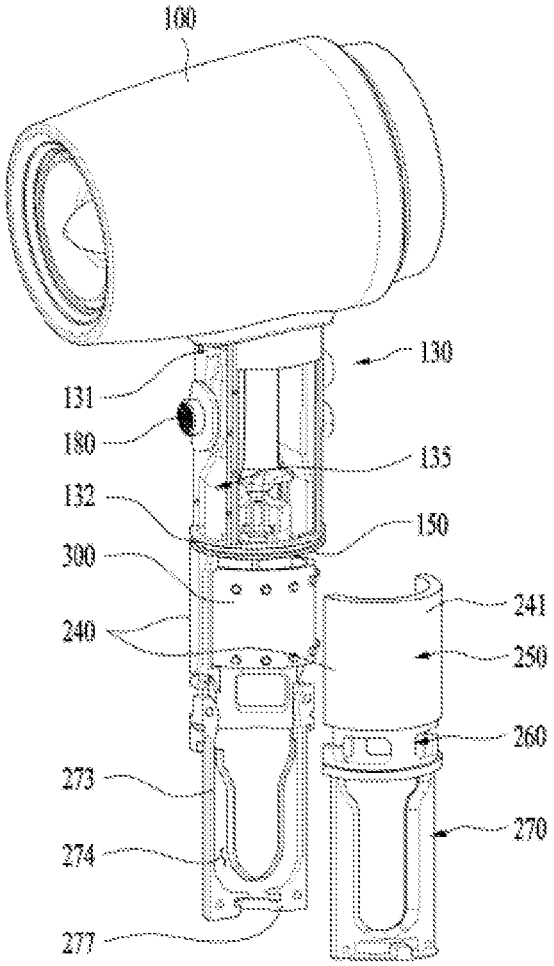

【Fig.5】
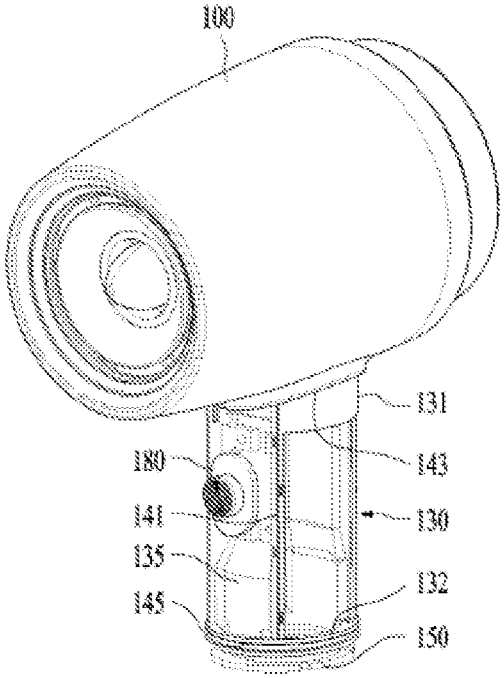

【Fig.6】
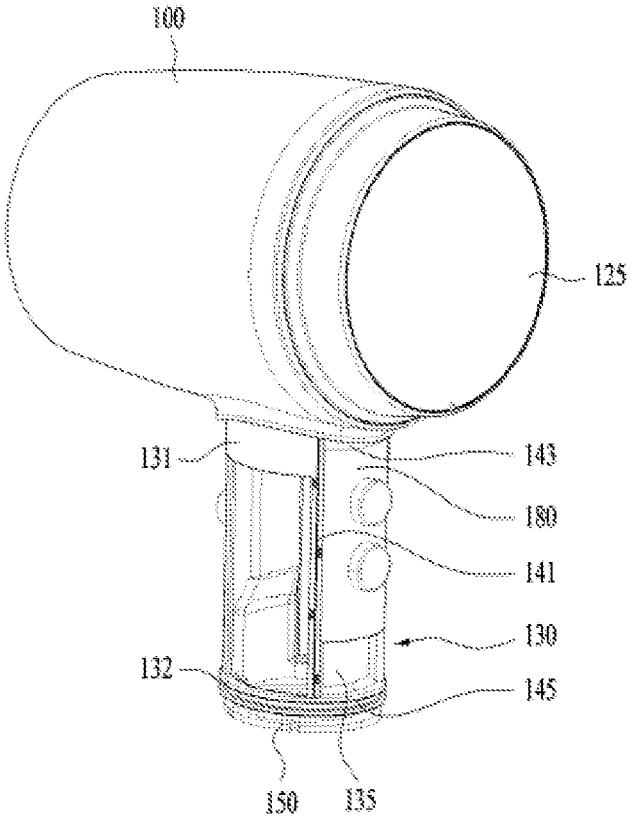

【Fig.7】
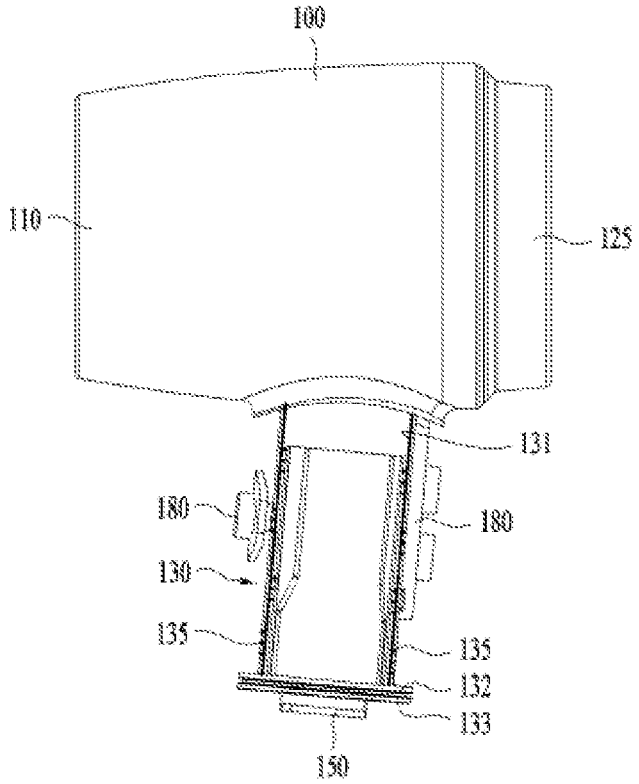

【Fig.8】
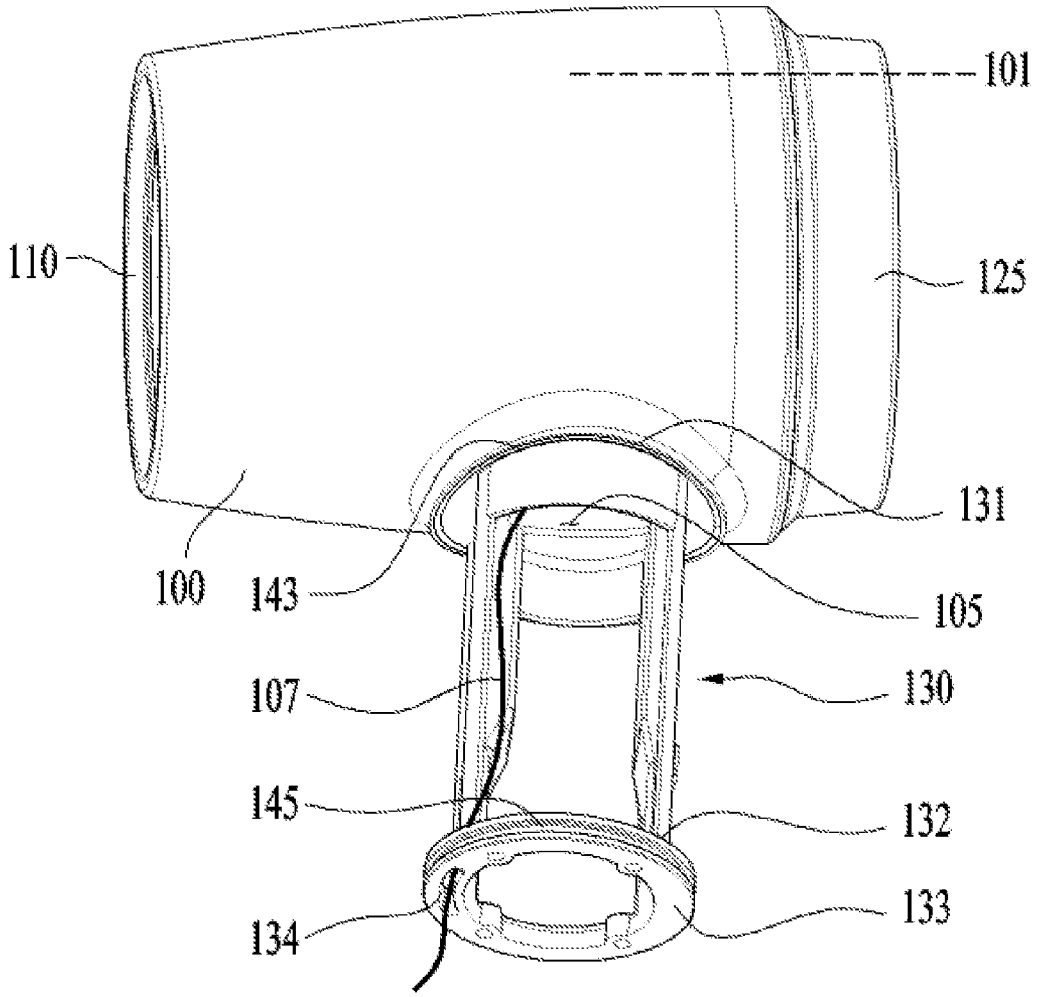

【Fig.9】
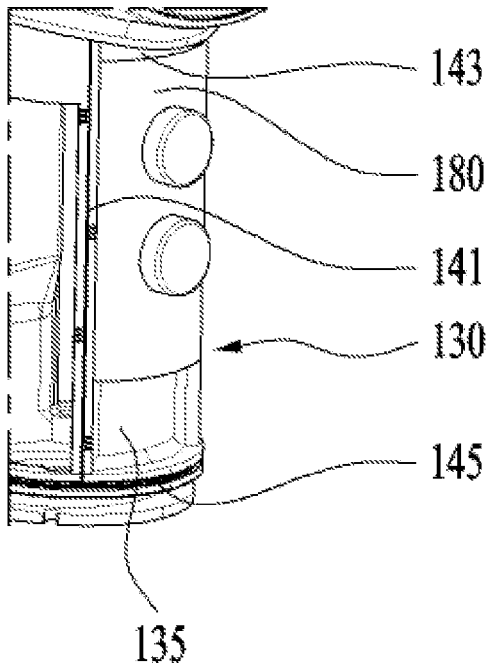

【Fig.10】
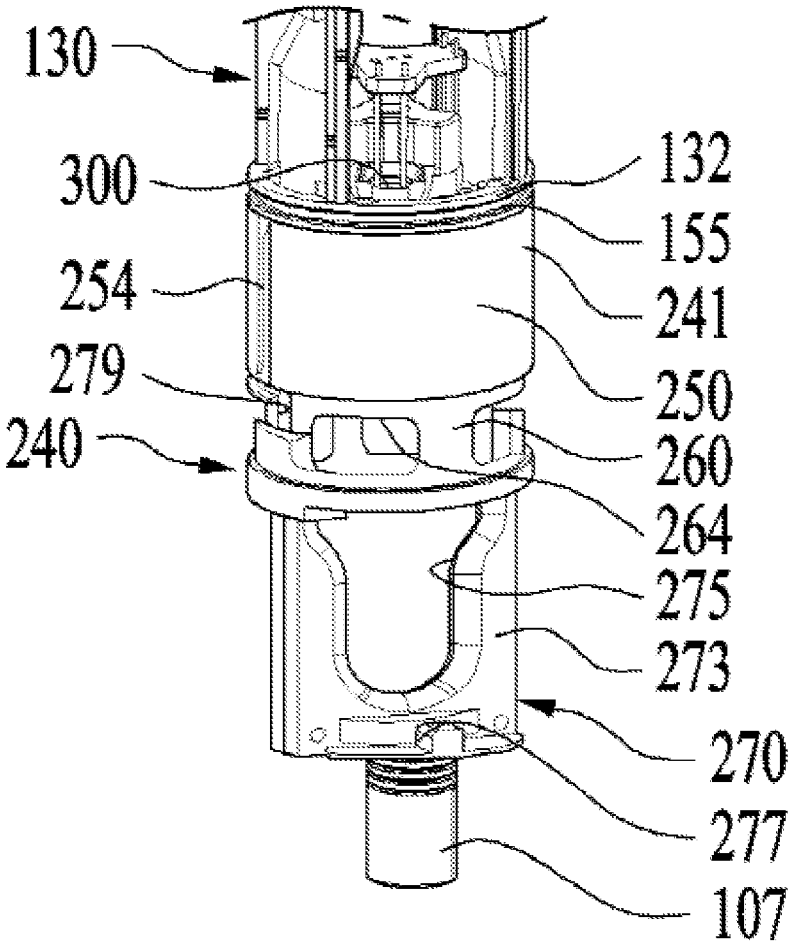

【Fig.11】
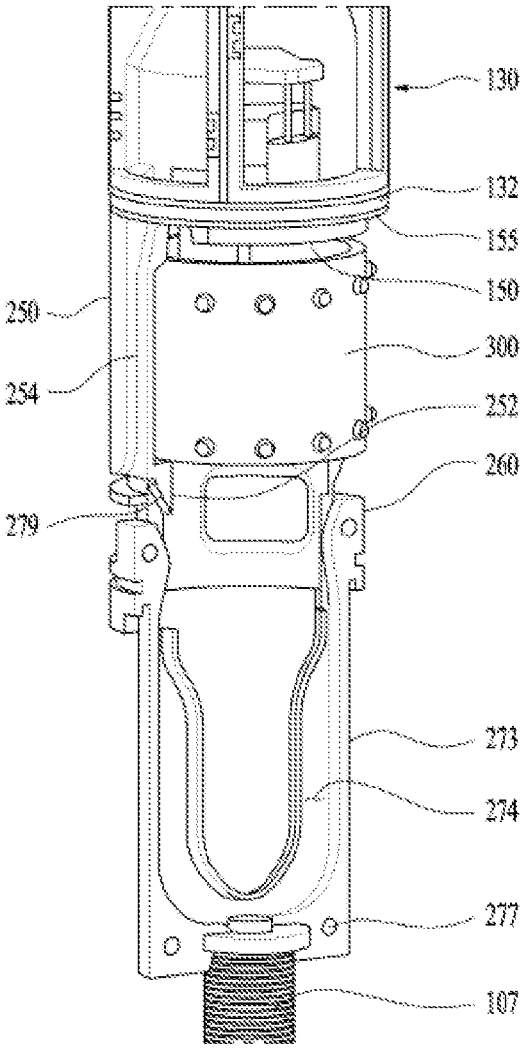

【Fig.12】
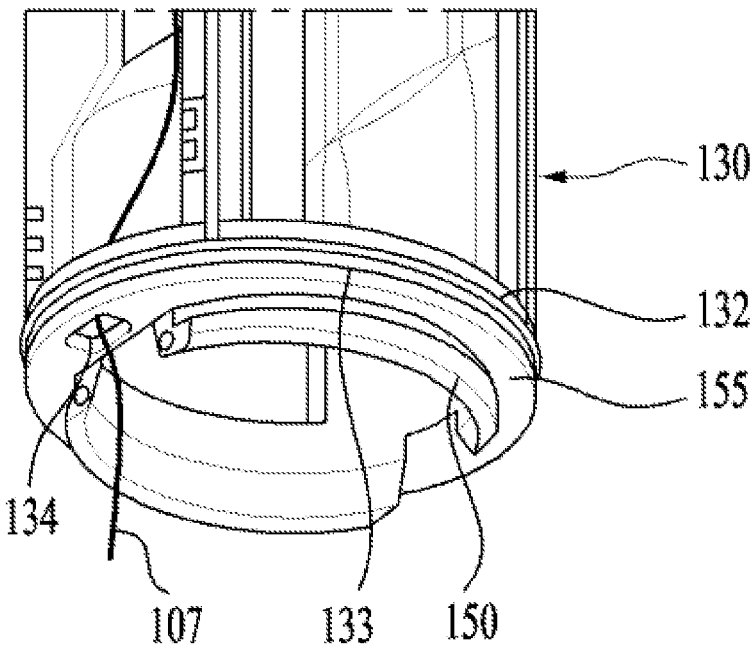

【Fig.13】
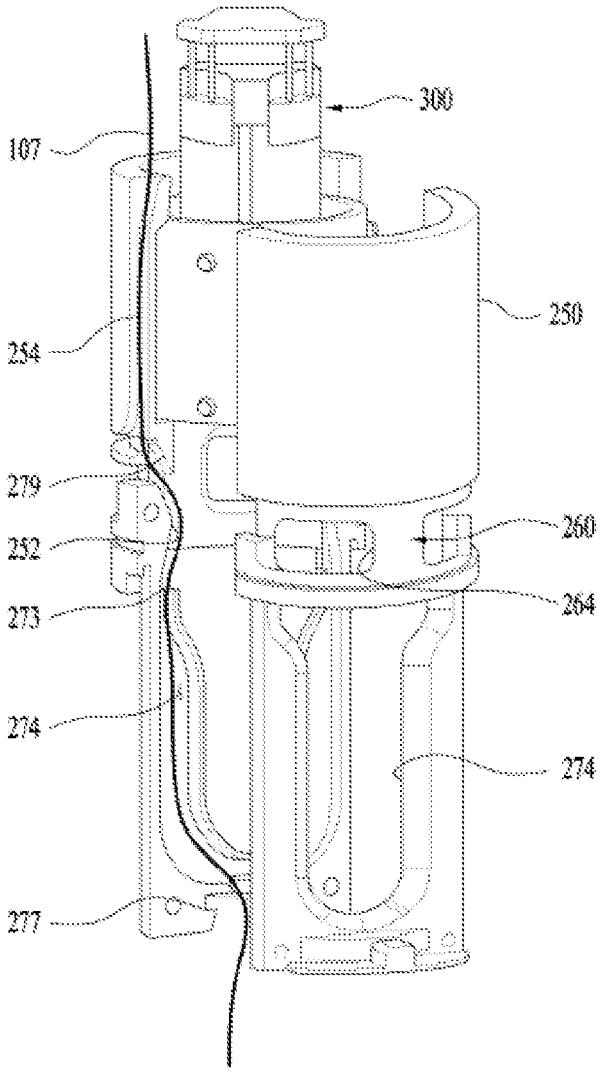

【Fig.14】
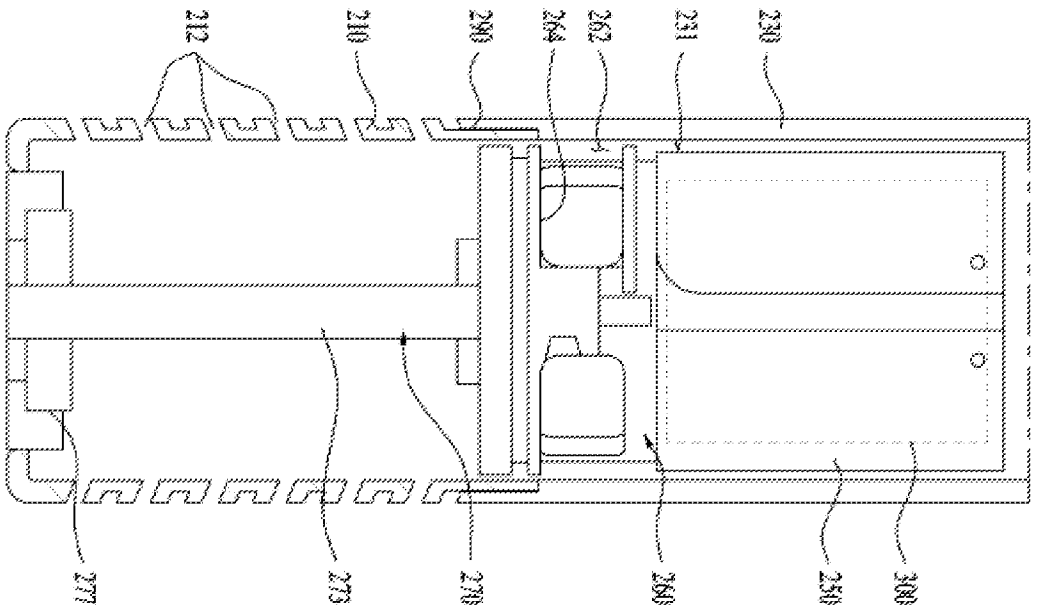

HAIRDRYER

CROSS-REFERENCE TO RELATED APPLICATIONS

This application is the National Stage filing under 35 U.S.C. 371 of International Application No. PCT/KR2022/001282, filed on Jan. 25, 2022, which claims the benefit of earlier filing date and right of priority to Korean Application No. 10-2021-0011458, filed on Jan. 27, 2021, the contents of which are all incorporated by reference herein in their entireties.

TECHNICAL FIELD

The present disclosure relates to a hairdryer, and more particularly to a hairdryer in which gas introduced through a gas inlet part is discharged through a gas discharge part.

BACKGROUND

To remove moisture from the human hair as much as desired in a wet state or to style the hair from the current shape to a desired shape, a hairdryer that discharges gas through a gas discharge part may be used.

A fan unit, etc. for fluidizing gas may be built-in inside the hairdryer, and a hairdryer including such an internal configuration may be designed to allow a user to use the hairdryer conveniently in consideration of a load thereof.

US patent document Ser. No. 10/004,313 discloses a hairdryer in which the center of gravity of the hair dryer is positioned adjacent to a handle as a fan unit and a gas inlet part are disposed on the handle held by a user.

However, in the hairdryer disclosed in the patent document U.S. Ser. No. 10/004,313, the fan unit is directly inserted into the handle held by the user, and vibration and noise generated from the fan unit are directly transmitted to the handle, thereby transmitting vibration to the user or causing noise.

In addition, to accommodate the fan unit inside the handle, the handle is divided into a half-cylinder shape, and an assembly line is formed to cross the handle in a longitudinal direction based on the appearance of the handle, degrading the appearance of the handle.

Therefore, it is an important need in the technical field to develop an efficient structure that effectively reduces vibration or noise generated from the hairdryer to relieve user discomfort, minimizes flow loss, and has a fan unit inside the handle.

DISCLOSURE

Technical Problem

Embodiments of the present disclosure provides a hairdryer in which a fan unit is stably and efficiently disposed inside a handle.

Embodiments of the present disclosure provides a hairdryer for effectively reducing vibration and noise generated by a fan unit.

Embodiments of the present disclosure provides a hairdryer for effectively reducing flow loss of gas while effectively arranging various components installed in a handle.

Technical Solution

An embodiment of the present disclosure may have a structure for excluding an assembly line from a handle of a hairdryer to improve product appearance. A handle and a head structure for mounting a fan motor while excluding the assembly line of the handle of the hairdryer may be applied.

An inner frame of a fan unit that includes a filter of a gas inlet while fixing the fan unit may be provided, and an extension that extends at a lower portion of a head and has a position at which a switch is assembled may be provided.

That is, according to an embodiment of the present disclosure, an assembly line in parallel to a longitudinal direction of a handle may be removed from an outer appearance while a fan motor is mounted inside a handle of a hairdryer. That is, a handle case may have a pipe shape. In addition, noise and vibration of the fan unit may be reduced, transmission of vibration to a head part may be minimized, and a weight of the hairdryer may be minimized.

According to an embodiment of the present disclosure, a hairdryer includes a body and a handle. The body includes a gas discharge part through which gas is discharged. The handle extends from the body and includes a gas inlet part into which gas is introduced and a gas flow path extending from the gas inlet part to the body. The body includes a body extension extending toward an inside of the gas flow path.

The handle includes a handle case, a fan unit, and a handle frame. The handle case defines at least a part of an outer appearance of the handle, and the body extension is into the gas flow path formed in the handle case.

The fan unit is provided on the gas flow path and fluidizes gas. The handle frame is provided on the gas flow path, coupled to the body extension, and coupled to the fan unit to fix the fan unit.

The body includes a communication hole communicating with the gas flow path, and the body extension extends from a circumference portion of the communication hole and has a space defining a part of the gas flow path therein.

The body includes a body case defining an outer appearance, and the body extension is integrally molded with the body case.

The handle case is molded in a pipe shape and coupled to the body to allow the body extension to be inserted thereinto.

The body extension includes an accommodator on which a manipulator configured to provide information to a user or receive information is accommodated, and the handle case has an open position corresponding to the accommodator to expose the manipulator to an outside.

The body extension further includes a first sealer extending along at least a part of a circumference of the accommodator and preventing gas from leaking to an outside through the accommodator.

The body extension further includes a second sealer surrounding an end of the body extension, which faces the body, and preventing a gas flow between the end and an inner surface of the handle case.

The body extension further incudes a third sealer surrounding a remaining end of the body extension and preventing a gas flow between the remaining end and the inner surface of the handle case.

The body extension includes a frame coupler having an end facing the body and a remaining end to which the handle frame is coupled, and the handle frame has an end facing the body extension, which is coupled to the frame coupler and fixed on the gas flow path.

The handle frame includes a fan unit coupler surrounding an outer circumferential surface of the fan unit, including the fan unit disposed therein, and coupled to the frame coupler The frame coupler includes a vibration isolation member provided between the frame coupler and the fan unit coupler and preventing transmission of vibration of the fan unit.

The frame coupler protrudes toward the handle frame from an end surface of the remaining end of the body extension, and the vibration isolation member is provided on the end surface and blocks contact between the end surface and the handle frame.

The gas inlet part is located farther from the body than the fan unit, and the fan unit coupler includes a noise reducer positioned between the fan unit and the gas inlet part and reducing noise of the fan unit and gas.

The noise reducer includes a noise reduction space formed between an outer surface of the fan unit coupler and an inner surface of the handle case, and a noise reduction hole formed in the fan unit coupler to allow the noise reduction space and the gas flow path to communicate with each other.

The gas inlet part includes a plurality of gas inlet holes located farther from the body than the fan unit, surrounding an outer circumferential surface of the handle, and allowing the gas flow path to communicate with an outside The handle further includes an inlet case coupled to a remaining end of the handle case having an end coupled to the body, defining a part of an outer appearance of the handle, and including the gas inlet part.

The handle case includes a wire mounting part extending away from the body in the fan unit coupler, positioned to be surrounded by the gas inlet part, and embedding a wire extending from the body therein.

The wire mounting part includes a wire extractor that is positioned at an end of the handle and through which the wire is extended out of the handle.

The wire mounting part includes a wire extension that extends from the fan unit coupler to be connected to the wire extractor and in which a wire space with the wire position therein is formed.

The fan unit coupler has an end facing the gas inlet part, at which a fan opening is formed, to supply gas to the fan unit, and the wire extension is provided in a plate shape in which a through hole is formed in a center and extends in a longitudinal direction of the handle, and the through hole is open toward the fan unit coupler to be connected to the fan opening.

The wire mounting part has an end facing the fan unit coupler, at which a wire retraction hole for retracting the wire is formed, the fan unit coupler has an outer surface on which a wire groove with the wire accommodated thereon is formed, and the wire is extended from the body, extends along the wire groove, and is retracted into the wire mounting part through the wire retraction hole.

A wire passage hole that faces the wire groove and through which the wire passes is formed at the remaining end of the body extension, and the wire passes through the wire passage hole and extends along the wire groove.

According to an embodiment of the present disclosure, the handle of the hairdryer includes a handle case defining at least a part of an outer appearance of the handle, the body extension being inserted into the gas flow path formed in the handle case, a handle frame provided on the gas flow path and coupled to the body extension, and a fan unit coupled to the handle frame and fixed on the gas flow path while being spaced apart from an inner surface of the handle case.

Advantageous Effects

Embodiments of the present disclosure provides a hairdryer in which a fan unit is stably and efficiently disposed inside a handle.

Embodiments of the present disclosure provides a hairdryer for effectively reducing vibration and noise generated by a fan unit.

Embodiments of the present disclosure provides a hairdryer for effectively reducing flow loss of gas while effectively arranging various components installed in a handle.

BRIEF DESCRIPTION OF THE DRAWINGS

FIG. 1 shows an outer appearance of a hairdryer according to an embodiment of the present disclosure.

FIG. 2 schematically shows a cross section of the inside of a hairdryer according to an embodiment of the present disclosure.

FIG. 3 shows a state in which a handle case and an inlet case of a handle are separated according to an embodiment of the present disclosure.

FIG. 4 shows a state in which a handle frame is separated from a hairdryer according to an embodiment of the present disclosure.

FIG. 5 is a perspective view of a body with a handle removed therefrom in a hairdryer according to an embodiment of the present disclosure.

FIG. 6 is a perspective view of a body with a handle removed therefrom in a hairdryer viewed from a rear side according to an embodiment of the present disclosure.

FIG. 7 is a side view of a body with a handle removed therefrom in a hairdryer according to an embodiment of the present disclosure.

FIG. 8 is a diagram showing a body extension in a hairdryer according to an embodiment of the present disclosure.

FIG. 9 is a diagram showing a manipulator and an accommodator in a hairdryer according to an embodiment of the present disclosure.

FIG. 10 is a diagram showing a handle removed from a handle case in a hairdryer according to an embodiment of the present disclosure.

FIG. 11 is a diagram showing the inside of a handle frame in a hairdryer according to an embodiment of the present disclosure.

FIG. 12 is a diagram showing a frame coupler of a body extension in a hairdryer according to an embodiment of the present disclosure.

FIG. 13 is a diagram showing a case in which a handle frame with a fan unit mounted thereon is separated from a hairdryer according to an embodiment of the present disclosure.

FIG. 14 is a diagram showing a cross section of a handle frame viewed from a side in a hairdryer according to an embodiment of the present disclosure.

DETAILED DESCRIPTION

Hereinafter, embodiments of the present disclosure will be described in detail with reference to the accompanying drawings so that the present disclosure may be easily realized by those skilled in the art.

However, the present disclosure may be achieved in various different forms and is not limited to the embodiments described herein. In the drawings, parts that are not related to a description of the present disclosure are omitted to clearly explain the present disclosure and similar reference numbers will be used throughout this specification to refer to similar parts.

In the present specification, redundant descriptions of the same components are omitted.

It will be understood that, when an element is referred to as being "connected to" another element, the element may be connected to the other element or intervening elements may also be present. In contrast, when an element is referred to as being "directly connected to" another element, there are no intervening elements present.

Specific terminology used in this specification is only for convenience of description and is not intended to be limiting of the illustrative embodiments.

A singular representation may include a plural representation unless it represents a definitely different meaning from the context.

In description of the present disclosure, the terms "comprising," "including," and "having" shall be understood to designate the presence of particular features, numbers, steps, operations, elements, parts, or combinations thereof, but not to preclude the presence or addition of one or more other features, numbers, steps, operations, elements, parts, or combinations thereof.

In description of the present disclosure, the term "and/or" may include a combination of a plurality of items or any one of a plurality of listed items. For example, "A or B" may include "only A", "only B", and/or "both A and B".

FIG. 1 shows a hairdryer according to an embodiment of the present disclosure, and FIG. 2 shows a cross section of the inside of the hairdryer shown in FIG. 1.

A hairdryer according to an embodiment of the present disclosure includes a body 100 and a handle 200 as shown in FIGS. 1 and 2.

The body 100 may include a gas discharge part 110 through which gas is discharged to the outside as shown in FIG. 1 and may include a body flow path 103 through which gas flows as shown in FIG. 2. The body flow path 103 may communicate with a gas flow path 220 of the handle 200.

That is, according to an embodiment of the present disclosure, the gas flow path 220 may extend from a gas inlet part 210 of the handle 200 to the body 100, and the body flow path 103 may communicate with the gas flow path 220 and extend from the flow path 220 to the gas discharge part 110.

The gas discharge part 110 may be provided on a front side of the body 100. The gas discharge part 110 may define a front surface of the body 100. That is, the gas discharge part 110 may be provided on the front of the body 100. The gas discharge part 110 may discharge gas through the gas flow path 220 and the body flow path 103 to the outside.

As shown in FIG. 2, the gas discharge part 110 may communicate with the body flow path 103 to allow gas passing through the body flow path 103 to be discharged to the outside. The gas discharge part 110 may include a gas discharge hole communicating with the body flow path 103 and discharging gas.

A plurality of gas discharge holes may be provided. For example, as shown in FIG. 1, the gas discharge hole may include a first discharge hole 111 and a second discharge hole 112. The first discharge hole 111 and the second discharge hole 112 may communicate with the body flow path 103 to discharge gas.

The gas discharge part 110 may include the first discharge hole 111, the second discharge hole 112, a guide cone 113, and a discharge body 114. The discharge body 114 may be disposed on one side of the body 100, for example, on the front surface of the body 100, the first discharge hole 111 may be formed in the discharge body 114, and the second discharge hole 112 may be formed between the discharge body 114 and an outer wall of the body 100.

That is, the second discharge hole 112 may be formed in an annular shape in a space formed between the discharge body 114 and the outer wall of the body 100. The second discharge hole 112 may be provided in an annular shape extending along a circumference of the discharge body 114.

The guide cone 113 may be provided in the first discharge hole 111. That is, gas may be discharged between the guide cone 113 and the discharge body 114 as shown in FIG. 1. In an embodiment of the present disclosure, an opening area between the discharge body 114 and the guide cone 113 may be defined as the first discharge hole 111.

The guide cone 113 may have a shape of a cone, of which a diameter decreases as a distance from the body 100 increases, and may guide a flow of gas discharged through the first discharge hole 111. For example, gas discharged through the gas discharge part 110 may be discharged forward without reducing a flow cross-sectional area by the guide cone 113 in the center.

In an embodiment of the present disclosure, the first discharge hole 111 and the second discharge hole 112 may each be provided in an annular shape. In the present disclosure, the annular shape may include a polygonal shape such as a quadrangle as well as an O shape.

According to an embodiment of the present disclosure, gas is discharged through the second discharge hole 112 with the first discharge hole 111, and thus a flow rate of gas provided to a user may be sufficiently ensured and a flow cross-sectional area may also be effectively increased.

In an embodiment of the present disclosure, the handle 200 may extend from the body 100. For example, the handle 200 may extend downward from the body 100. However, an extending direction of the handle 200 is not necessarily limited to a downward direction, and furthermore, the handle 200 may be provided to be folded through a hinge or the like.

The handle 200 may be integrally formed with the body 100 or may be manufactured separately and coupled to the body 100. A manipulator 180 may be disposed on the handle 200. The manipulator 180 may include a button manipulated by the user and a display for providing information to the user.

FIGS. 1 and 2 show a state in which the manipulator 180 including a button operated by a user is provided on the handle 200. A plurality of manipulators 180 may be provided, and may be disposed on the handle 200. FIG. 2 shows a state in which the manipulators 180 are provided at the front and rear of the handle 200, respectively, according to an embodiment of the present disclosure.

Referring to FIG. 1, in an embodiment of the present disclosure, the gas inlet part 210 may be provided in the handle 200. The gas inlet part 210 may include a plurality of gas inlet holes 212 penetrating an outer wall of the handle 200, and the gas flowing through the gas inlet holes 212 may be transferred to the body flow path 103 through path 220 through the gas flow path 220 formed inside the handle 200.

The gas inlet part 210 may be formed at an end of the handle 200. The gas inlet part 210 may be provided to cover a circumference of the handle 200. That is, the gas flow path 220 of the handle 200 may extend from one end to the other end of the handle 200, and one end of the gas flow path 220 may be connected to the body flow path 103 of the body 100, and the other end of the gas flow path 220 may be connected to the gas inlet part 210.

Various power consumption units such as a controller 120 and a temperature adjuster 109 may be provided inside the body 100, and a wire 107 for transmitting power to the power consumption units may extend along the inside of the handle 200, that is, along the gas flow path 220 and may be extended out through an end of the handle 200.

FIG. 2 schematically shows a cross section of the inside of a hairdryer according to an embodiment of the present disclosure. With reference to FIG. 2, a gas flow of a hairdryer according to an embodiment of the present disclosure will be described below.

First, according to an embodiment of the present disclosure, external gas may flow into the handle 200 through the gas inlet part 210 provided in the handle 200. The gas flow path 220 may be formed inside the handle 200, and gas introduced through the gas inlet part 210 may flow along the gas flow path 220.

A fan unit 300 may be provided inside the handle 200. The fan unit 300 may be provided to fluidize gas on the gas flow path 220. For example, the fan unit 300 may include a fan and a motor for rotating the fan, and the flow of gas may be formed through rotation of the fan.

When the fan unit 300 is operated, the gas introduced through the gas inlet part 210 may flow toward the body 100 along the gas flow path 220, and the gas in the gas flow path 220 may be transferred to the body flow path 103 of the body 100. That is, the gas flow path 220 of the handle 200 and the body flow path 103 of the body 100 may define one flow path together.

Gas transferred to the body flow path 103 of the body 100 may be discharged to the outside through the gas discharge part 110 of the body 100 and provided to a user. That is, in an embodiment of the present disclosure, the gas inlet part 210, the gas flow path 220, the body flow path 103, and the gas discharge part 110 may communicate with each other, and gas introduced through the gas inlet part 210 may be discharged through the gas discharge part 110 while passing through the gas flow path 220 and the body flow path 103 and having a controlled flow rate and temperature.

In an embodiment of the present disclosure, the body 100 may include a body case 101 defining an outer appearance of the body 100, and the body flow path 103 may be formed inside the body case 101.

The temperature adjuster 109 for adjusting the temperature of gas may be provided inside the body case 101, that is, inside the body flow path 103. The temperature adjuster 109 may be provided in various types. For example, the temperature adjuster 109 may correspond to a heater that generates heat by consuming electrical energy.

Gas passing through the temperature adjuster 109 may be heated by the temperature adjuster 109 and discharged to the outside through the gas discharge part 110. The temperature adjuster 109 may be disposed between the gas flow path 220 and the gas discharge part 110.

The body 100 may include a user part 125 for providing information such as an operating state of the hairdryer to the user. For example, the gas discharge part 110 may be provided at a front side of the body 100, and the user part 125 may be provided at a rear side.

The user part 125 may include a display for providing information such as gas temperature and a flow rate. In addition, the user part 125 may include an input unit for adjusting the operation state of a hairdryer.

The input unit may be provided in various forms. For example, the input unit may be provided in a button method, a dial method, or a touch method.

In an embodiment of the present disclosure, the user may easily and effectively grasp the operating state of the hairdryer through the user part 125 provided in the body 100, and may effectively change the operating state.

The hairdryer according to an embodiment of the present disclosure may include the controller 120. The controller 120 may be provided inside the body 100 or the handle 200. FIG. 2 shows the controller 120 disposed inside the body 100 according to an embodiment of the present disclosure.

The controller 120 may include a substrate and a device. The controller 120 may be connected to the user part 125, the manipulator 180, the temperature adjuster 109, and the fan unit 300. The controller 120 may receive a user command through the user part 125 and/or the manipulator 180 and control the temperature adjuster 109 and the fan unit 300 according to the command.

Various programs for caring for the user hair may be pre-stored in the controller 120. For example, various programs including a drying mode for drying hair, a styling mode for styling hair, a cooling mode for lowering hair temperature, and the like are preset in the controller 120, and the user may perform effective hair care by selecting any one of the above programs through the manipulator 180 or the user part 125.

In an embodiment of the present disclosure, the controller 120 may be spaced apart from the temperature adjuster 109 to suppress heat damage. For example, the temperature adjuster 109 is disposed within the body flow path 103, the gas discharge part 110 is provided at a front side of the body 100, and the controller 120 is disposed at a rear side of the temperature adjuster 109, and thus heat of the temperature adjuster 109 and heat of gas passing through the temperature adjuster 109 may be prevented from being transferred to the controller 120.

FIG. 3 shows a state in which a handle case 230 and an inlet case 290 of the handle 200 are separated, and FIG. 4 shows the body 100 and a handle frame 240 according to an embodiment of the present disclosure.

In an embodiment of the present disclosure, the body 100 includes the gas discharge part 110 through which gas is discharged, the handle 200 may extend from the body 100, and include the gas inlet part 210 into which gas is introduced, and the gas flow path 220 extending from the inlet part 210 to the body 100.

The body 100 includes a body extension 130 extending into the gas flow path 220, and the handle 200 includes the handle case 230, the fan unit 300, and the handle frame 240.

The body extension 130 extends from the body 100 and is disposed inside the handle 200, that is, inside the gas flow path 220. The body extension 130 may extend from the body case 101. The body extension 130 may be molded integrally with the body case 101 or manufactured separately and coupled to the body case 101.

FIGS. 3 and 4 show the body extension 130 integrally molded with the body case 101, and a detailed description of the body extension 130 will be given later.

The handle case 230 may define at least a part of an outer appearance of the handle 200, and the gas flow path 220 may be formed therein, and thus the body extension 130 may be inserted into the gas flow path 220.

The handle case 230 may define an outer wall of the handle 200, a space may be formed therein, and the space may be provided to define the gas flow path 220. The handle case 230 may be integrally molded with the body 100 or manufactured separately and coupled to the body 100. FIG. 3 shows the handle case 230 manufactured separately from the body 100 and separated from the handle 200.

As will be described later, the inlet case 290 may be coupled to the handle case 230, and the inlet case 290 and the handle case 230 may define the outer appearance of the handle 200 together. The inlet case 290 may be coupled to an end of the handle 200 and may include the gas inlet part 210.

The fan unit 300 is provided in the gas flow path 220 to fluidize gas. That is, the fan unit 300 is disposed inside the handle case 230 to fluidize gas, and may include a fan, a motor, and a motor mount.

In an embodiment of the present disclosure, the handle frame 240 is provided on the gas flow path 220, is coupled to the fan unit 300, and is coupled to the body extension 130 to fix the fan unit 300.

Referring to FIGS. 3 and 4, the handle frame 240 may be inserted into the handle case 230. That is, the handle frame 240 may be disposed inside the handle case 230 to fix the fan unit 300.

The handle frame 240 may be coupled to the fan unit 300, and a coupling method with the fan unit 300 may be various. FIGS. 3 and 4 show a state in which a part of the handle frame 240 is provided to surround the fan unit 300.

The handle frame 240 may be coupled to the body extension 130 as well as to the fan unit 300. The handle frame 240 may have a fixed position within the gas flow path 220 by being coupled to the body extension 130 extending from the body 100, and the fan unit 300 coupled to the handle frame 240 may also have a fixed position on the gas flow path 220.

In an embodiment of the present disclosure, as the fan unit 300 and the gas inlet part 210 are provided on the handle 200, the center of gravity of the entire hairdryer is located on the handle 200 or located adjacent to the handle 200, and thus the user may conveniently use a hairdryer.

In addition, according to an embodiment of the present disclosure, the fan unit 300 is fixed using the handle frame 240, thereby implementing an effective structure for fixing the fan unit 300 inside the handle 200.

For example, the handle case 230 may not include a separate component for fixing the fan unit 300, and since the fan unit 300 does not form a coupling relationship with the handle case 230, vibration and noise transferred to the handle case 230 from the fan unit 300 may be effectively reduced.

In addition, according to an embodiment of the present disclosure, the handle frame 240 and the fan unit 300 are fixed through the body extension 130 extending from the body 100, and thus a coupling relationship between the handle case 230 and the handle frame 240 is not formed, and accordingly, vibration and noise transferred to the handle case 230 through the handle frame 240 may be effectively reduced.

Furthermore, the fan unit 300 may be effectively fixed, vibration and noise transferred to a user may be effectively prevented, and a split structure of the handle case 230 may be eliminated, by using the coupling relationship between the body extension 130, the handle frame 240, and the fan unit 300, thereby effectively improving the appearance quality of the handle 200.

FIG. 5 is a perspective view of the body 100 excluding the handle 200 from a hairdryer viewed from a front side according to an embodiment of the present disclosure, FIG. 6 is a perspective view of the body 100 of FIG. 5 viewed from a rear side. FIG. 7 shows the body 100 of FIG. 5 viewed from a side.

Referring to FIGS. 5 to 7, the body 100 includes the body case 101 in which the gas discharge part 110 and/or the user part 125 are provided, and includes the body extension 130 extending from the body 100. The body extension 130 may be manufactured separately from the body case 101 and coupled to the body case 101, but in FIGS. 5 to 7, the body case 101 and the body extension 130 are integrally molded to effectively improve the manufacturing process.

FIG. 8 shows the body extension 130 and a communication hole 105 according to an embodiment of the present disclosure. Referring to FIG. 8, in an embodiment of the present disclosure, the body 100 is provided with the communication hole 105 communicating with the gas flow path 220, the body extension 130 is formed from a circumference portion of the communication hole 105, and a space defining a part of the gas flow path 220 may be formed in the body extension 130.

The communication hole 105 may be formed on one side facing the handle 200 in the body 100, that is, the body case 101. The communication hole 105 may be provided to face the gas flow path 220 of the handle 200, and the body flow path 103 and the gas flow path 220 may be connected to each other through the communication hole 105.

The body extension 130 may extend from the circumference of the communication hole 105. That is, the body extension 130 may extend from the circumference surrounding the communication hole 105 in the body case 101 toward the inside of the handle 200, that is, toward the gas flow path 220.

A space defining a part of the gas flow path 220 may be formed inside the body extension 130. That is, the body extension 130 includes a space therein to allow the gas flow path 220 and the communication hole 105 to communicate with each other, and the space may be provided to communicate with the gas flow path 220 and the communication hole 105.

In an embodiment of the present disclosure, the body extension 130 extends from the circumference of the communication hole 105 to the inside of the gas flow path 220, and at the same time, may have a space open toward the gas flow path 220 to smoothly flow gas through the communication hole 105.

In an embodiment of the present disclosure, the body 100 includes the body case 101 defining an outer appearance, and the body extension 130 may be integrally molded with the body case 101.

Accordingly, since a coupling process between the body extension 130 and the body case 101 may be omitted, the manufacturing process may be effectively improved, and structural stability between the body extension 130 and the body case 101 may be effectively improved.

In an embodiment of the present disclosure, the handle case 230 may be molded into a pipe shape and coupled to the body 100 to allow the body extension 130 to be inserted into the handle case 230.

FIG. 3 shows the handle case 230 provided in a pipe shape and having one end 231 coupled to the body 100 to allow the body extension 130 and the handle frame 240 to be inserted thereinto.

According to an embodiment of the present disclosure, when the body extension 130 and the handle frame 240 are used, even if the fan unit 300 is not formed as a split structure, the fan unit 300 may be stably and effectively fixed inside the handle 200.

For example, according to an embodiment of the present disclosure, even if the handle case 230 is not formed of a plurality of split structures having an assembly line extending in a longitudinal direction of the handle 200, the fan unit 300 and the handle frame 240 may be effectively fixed inside the handle case 230.

Accordingly, in an embodiment of the present disclosure, an assembly line extending in a longitudinal direction of the handle 200 may not be formed on the outer appearance of the handle 200, and furthermore, the assembly line may not be identified from the outer appearance of the handle 200, and thus the appearance quality of the hairdryer may be improved and the aesthetic sense of a user may be improved.

Since the assembly line in the longitudinal direction of the handle case 230 is excluded, the amount of gas leaking from the gas flow path 220 inside the handle case 200 through the assembly line may be effectively reduced.

In an embodiment of the present disclosure, the body extension 130 and the handle frame 240 are used together, and thus even if the body extension 130 integrally molded with the body case 101 is not formed as a split structure, the fan unit 300 may be stably surrounded and fixed.

In other words, in an embodiment of the present disclosure, only the handle frame 240 is provided in the form of a split cylinder, and even if the body extension 130 and the handle case 230 are not formed as a divided body, the fan unit 300 is stably fixed, thereby improving appearance quality and preventing vibration and noise.

FIG. 9 shows an accommodator 135 and the manipulator 180 provided in the body extension 130 according to an embodiment of the present disclosure. Referring to FIG. 9, in an embodiment of the present disclosure, the body extension 130 may include the accommodator 135.

The manipulator 180 providing information to a user or receiving information may be accommodated in the accommodator 135. In addition, the handle case 230 may have an open portion corresponding to the accommodator 135 and thus the manipulator 180 is exposed to the outside.

FIGS. 1 and 2 show the handle case 230 with an open portion corresponding to the manipulator 180 and the accommodator 135 to allow the manipulator 180 to be exposed to the outside according to an embodiment of the present disclosure.

The accommodator 135 may be provided in various forms to which the manipulator 180 is to be coupled. For example, the accommodator 135 may include a support surface on which the manipulator 180 comes into contact with and is supported, and the manipulator 180 may be disposed and fixed on the support surface of the accommodator 135.

In an embodiment of the present disclosure, the accommodator 135 is provided in the body extension 130 extending from the body 100, and thus even if the manipulator 180 is placed on the handle 200, there is no need to provide a separate structure for assembling the manipulator 180 to the handle case 230, and thus a production and assembly process of the handle 200 may be effectively improved, and a stable structure of the handle 200 may be implemented.

That is, in an embodiment of the present disclosure, the accommodator 135 for seating the manipulator 180 on the body extension 130 to be coupled to the fan unit 300 and the handle frame 240 is provided, and thus the fan unit 300 may be effectively fixed inside the handle 200, and the manipulator 180 may be effectively placed on the handle 200 without additional components.

The manipulator 180 may be provided in a button method, a dial method, a touch method, or the like, and may further include a display unit for providing information to a user.

FIG. 9 shows the manipulator 180 provided in a button manner according to an embodiment of the present disclosure. A user may operate a hairdryer by manipulating the manipulator 180.

A plurality of manipulators 180 may be provided. FIG. 5 shows the manipulator 180 disposed at a front side of the handle 200, and FIG. 6 shows the manipulator 180 disposed at a rear side of the handle 200.

The handle case 230 may have an open portion corresponding to the button or the like to allow the button or the like of the manipulator 180 inserted into the handle case 230 to be exposed to the outside of the handle case 230.

Referring to FIG. 9, in an embodiment of the present disclosure, the body extension 130 may further include a first sealer 141.

The first sealer 141 may extend along at least a part of a circumference of the accommodator 135 to prevent gas from leaking to the outside through the accommodator 135.

The first sealer 141 may block a flow of gas by shielding between an outer surface of the body extension 130 and an inner surface 221 of the handle case 230. The first sealer 141 may be made of a material having elasticity.

The first sealer 141 may extend along at least a part of the circumference of the accommodator 135. For example, the first sealer 141 may be provided in an annular shape that surrounds the circumference of the accommodator 135 as a whole, or may extend along a part of the circumference of the accommodator 135 that needs to be sealed.

A first sealing groove into which the first sealer 141 is to be inserted and fixed may be provided in the body extension 130, and the first sealer 141 may be inserted into the first sealing groove. The first sealer 141 may be integrally formed with the body extension 130.

As described above, the handle case 230 includes an opening for exposing the manipulator 180 to the outside, and gas flows between the handle case 230 and the body extension 130 and leaks to the outside through the opening.

The gas flow path 220 is formed inside the handle 200, and when gas leaks from the gas flow path 220, it may be disadvantageous due to a loss of gas flow rate, and may cause vibration and noise.

In the present disclosure, the body extension 130 extending from the body 100 is provided, the manipulator 180 is accommodated on the body extension 130, thereby enabling convenient and stable placement of the manipulator 180, and furthermore, gas may be effectively prevented from leaking through the opening of the handle case 230, in which the manipulator 180 is exposed through the first sealer 141.

In an embodiment of the present disclosure, the hairdryer may further include a second sealer 143 that surrounds one end 131 toward the body 100 from the body extension 130 and prevents gas flow between the one end 131 and the inner surface 221 of the handle case 230. FIGS. 8 and 9 shows the second sealer 143 provided at the one end 131 of the body extension 130 according to an embodiment of the present disclosure.

The second sealer 143 may be disposed between the one end 131 of the body extension 130 and the inner surface 221 of the handle case 230 to prevent a flow of gas. The second sealer 143 may be provided in an annular shape to surround the one end 131 of the body extension 130.

The second sealer 143 is made of an elastic material and may be placed between the one end 131 of the body extension 130 and the inner surface 221 of the handle case 230 in a pressurized state.

A second sealing groove into which the second sealer 143 is to be inserted and fixed may be provided in the body extension 130, and the second sealer 143 may be inserted into the second sealing groove. The second sealer 143 may be integrally formed with the body extension 130.

In an embodiment of the present disclosure, the handle case 230 is provided in a pipe shape and may be coupled to the body 100 to allow the body extension 130 to be inserted into the handle case 230 through the one end 231 of the handle case 230.

Accordingly, a gap through which gas may flow may be formed between the one end 131 of the body extension 130 and the inner surface 221 of the handle case 230, and a gap through which gas leaks to the outside may be formed between the body case 101 and the one end 231 of the handle case 230.

Accordingly, in an embodiment of the present disclosure, the second sealer 143 is provided at the one end 131 of the body extension 130, thereby effectively preventing gas from flowing between the one end 131 of the body extension 130 and the inner surface 221 of the handle case 230 and from leaking through the one end 231 of the handle case 230.

The body extension 130 further includes a third sealer 145 surrounding another end 132 of the body extension 130 and preventing gas from flowing between the other end 132 and the inner surface 221 of the handle case 230.

FIGS. 8 and 9 show the body extension 130 including the third sealer 145 according to an embodiment of the present disclosure.

The third sealer 145 may be disposed between the other end 132 of the body extension 130 and the inner surface 221 of the handle case 230 to prevent a flow of gas. The third sealer 145 may be provided in an annular shape to surround the other end 132 of the body extension 130.

The third sealer 145 may be made of an elastic material and may be placed between the other end 132 of the body extension 130 and the inner surface 221 of the handle case 230 in a pressurized state.

A third sealing groove into which the third sealer 145 is to be inserted and fixed may be provided in the body extension 130, and the third sealer 145 may be inserted into the third sealing groove. The third sealer 145 may be integrally formed with the body extension 130.

According to an embodiment of the present disclosure, gas may be prevented from flowing between the other end 132 of the body extension 130 and the inner surface 221 of the handle case 230 through the third sealer 145, and thus gas may be effectively prevented from leaking from an opening area of the handle case 230, through which the manipulator 180 is exposed or an assembly line of the handle case 230 and the body 100.

In an embodiment of the present disclosure, the first sealer 141, the second sealer 143, and the third sealer 145 may be provided to surround the accommodator 135 together. FIG. 9 shows a state in which the first sealer 141, the second sealer 143, and the third sealer 145 are arranged to surround a circumference of the accommodator 135 according to an embodiment of the present disclosure.

In the present disclosure, the first sealer 141, the second sealer 143, and the third sealer 145 may be manufactured separately, but FIG. 9 shows a state in which the first sealer 141, the second sealer 143, and the third sealer 145 are molded to be connected to each other according to an embodiment of the present disclosure.

According to an embodiment of the present disclosure, a sealing structure in which the first sealer 141, the second sealer 143, and the third sealer 145 surround a circumference of the accommodator 135 together to effectively prevent gas from leaking through the accommodator 135 may be implemented.

FIG. 10 shows the handle frame 240 coupled to the body extension 130, FIG. 11 shows the inside of the handle frame 240 in a state in which a part of the handle frame 240 is removed, and FIG. 12 shows a frame coupler 150 to which the handle frame 240 is coupled in the body extension 130.

Referring to FIGS. 10 to 12, according to an embodiment of the present disclosure, the body extension 130 may include the frame coupler 150 in which the one end 131 faces the body 100 and the handle frame 240 is coupled to the other end 132, and the handle frame 240 may be fixed on the gas flow path 220 by coupling one end 241 facing the body extension 130 to the frame coupler 150.

As shown in FIGS. 10 and 11, the body extension 130 and the handle frame 240 may extend parallel to a longitudinal direction of the handle 200, and the body extension 130 and the handle frame 240 may be disposed parallel to a longitudinal direction of the handle 200.

That is, the body extension 130 may include the frame coupler 150 in which the one end 131 faces the body 100, the other end 132 faces the handle frame 240, and the handle frame 240 is coupled to the other end 132 of the body extension 130, and the one end 241 of the handle frame 240 may be coupled to the frame coupler 150 provided at the other end 132 of the body extension 130.

A coupling method of the handle frame 240 and the frame coupler 150 may be various. For example, the handle frame 240 may be coupled to the frame coupler 150 using a coupling device such as a bolt, or may be coupled to the frame coupler 150 using a hook or a fit-fitting method.

In an embodiment of the present disclosure, the body extension 130 and the handle frame 240 are coupled and disposed in the longitudinal direction of the handle 200 through the frame coupler 150, and thus gas may smoothly flow and a space inside the gas flow path 220 may be efficiently used.

Referring to FIGS. 10 and 11, in an embodiment of the present disclosure, the handle frame 240 may include a fan unit coupler 250 that surrounds an outer circumferential surface of the fan unit 300, includes the fan unit 300 disposed therein, and is coupled to the frame coupler 150.

The fan unit coupler 250 may include a space in which the fan unit 300 is accommodated, and the space may define a part of the gas flow path 220. That is, the fan unit coupler 250 may be provided in a shape surrounding an outer circumferential surface of the fan unit 300, and may have both ends that is open to allow gas to flow.

The fan unit coupler 250 may be provided at the one end 241 of the handle frame 240 facing the body extension 130. That is, the one end 241 facing the body extension 130 from the fan unit coupler 250 may be coupled to the frame coupler 150 of the body extension 130.

The handle frame 240 is fixed to the other end 132 of the body extension 130, and as the fan unit 300 moves away from the other end 132 of the body extension 130, vibration generated from the fan unit 300 may increase. According to an embodiment of the present disclosure, the fan unit 300 may be accommodated on the fan unit coupler 250 disposed at the one end 241 of the handle frame 240 of the fan unit 300, and thus the fan unit 300 may be positioned adjacent to the body extension 130 and a generation amount of vibration may be effectively reduced.

Furthermore, in the present disclosure, the handle frame 240 may be provided as a plurality of split structures in the form of a half cylinder as described above, and the plurality of split structures may be coupled in a state in which the fan unit 300 is positioned inside the plurality of split structures, and thus the fan unit 300 may be stably fixed inside the fan unit coupler 250.

In s process of fixing the fan unit 300 as above, that is, in s process of disposing the fan unit 300 inside the fan unit coupler 250 and coupling the plurality of split structures, coupling between the fan unit coupler 250 and the frame coupler 150 of the body extension 130 may be simultaneously made, thereby efficiently improving an assembly process.

Referring to FIGS. 10 to 12, in an embodiment of the present disclosure, a vibration isolation member 155 may be provided between the frame coupler 150 and the fan unit coupler 250 to prevent vibration from being transferred from the fan unit 300.

The vibration isolation member 155 may be made of a material to be easily deformed and restored. The vibration isolation member 155 may be disposed between the frame coupler 150 and the fan unit coupler 250 to prevent transmission of vibration, and thus vibration transmitted to the body extension 130 through the fan unit coupler 250 may be effectively prevented.

Referring to FIG. 12, the frame coupler 150 may be provided to protrude from an end surface 133 of the other end 132 of the body extension 130 toward the handle frame 240, and the vibration isolation member 155 may be provided on the end surface 133 to block contact with the end surface 133 and the handle frame 240.

Specifically, the body extension 130 may extend from a circumference of the communication hole 105 formed in the body case 101 as described above. The one end 131 of the body extension 130 may extend from the body case 101, and the other end 132 may face the handle frame 240.

The frame coupler 150 provided at the other end 132 of the body extension 130 may protrude from the other end 132 toward the fan unit coupler 250. The other end 132 of the body extension 130 may have an annular shape, and the frame coupler 150 may have an annular shape to correspond to the other end 132 of the body extension 130.

The other end 132 of the body extension 130 may have the end surface 133 facing the handle frame 240, and the frame coupler 150 may protrude from the end surface 133 toward the handle frame 240. The frame coupler 150 may include a coupling extension extending from the end surface 133 toward the handle frame 240 and a coupling locker protruding from the extension toward the handle case 230.

The one end 241 of the handle frame 240, that is, the one end 241 of the fan unit coupler 250, may have an inner surface on which a frame flange caught by the coupling locker is provided. The handle frame 240 may be coupled to the frame coupler 150 of the body extension 130 while the frame flange is caught by the coupling locker.

Referring to FIGS. 10 and 11, in an embodiment of the present disclosure, the handle frame 240 may be provided with a plurality of split structures that are split along a circumference direction. FIG. 11 shows that the handle frame 240 is provided in a pair of half-cylinder types, and the inside of the handle frame 240 is exposed by removing one of the pair of half-cylinders.

That is, the handle frame 240 may be provided with a plurality of split structures that are split along the circumference direction, and the plurality of split structures are coupled to each other to allow the frame flange to be caught by the coupling locker while the fan unit 300 is disposed in the fan unit coupler 250, and thus the handle frame 240 and the body extension 130 may be coupled to each other.

The one end 241 of the handle frame 240 may have an end surface facing the body extension 130, and the end surface of the handle frame 240 and the end surface 133 of the body extension 130 may face each other. The vibration isolation member 155 may be disposed between the end surface 133 of the body extension 130 and the end surface of the handle frame 240.

The vibration isolation member 155 may be provided in a shape corresponding to the end surface 133 of the body extension 130 or the end surface of the handle frame 240. For example, the vibration isolation member 155 may have an annular shape corresponding to a cross section of the body extension 130 or the handle frame 240.

The vibration isolation member 155 may be provided on the end surface 133 of the body extension 130 or the end surface of the handle frame 240. FIG. 12 shows a state in which the vibration isolation member 155 is provided to cover the end surface 133 of the body extension 130 according to an embodiment of the present disclosure.

Contact between the end surface 133 of the body extension 130 and the end surface of the handle frame 240 may be blocked by the vibration isolation member 155. Vibration transmitted from the handle frame 240 including the fan unit coupler 250 may be reduced by the vibration isolation member 155 while being transmitted to the end surface 133 of the body extension 130.

Accordingly, in an embodiment of the present disclosure, the fan unit 300 may be fixed on the gas flow path 220 using the body extension 130 and the handle frame 240, and furthermore, even if the handle frame 240 is coupled to the body extension 130, vibration transmitted from the fan unit 300 to the body extension 130 may be blocked or reduced by the vibration isolation member 155.

The vibration isolation member 155 may be made of various materials. For example, the vibration isolation member 155 may be made of a material that is easily deformed and restored, or may be made of a porous material that advantageously prevents transmission of vibration.

FIG. 13 shows an exploded view of the handle frame 240 according to an embodiment of the present disclosure, and FIG. 14 shows the handle frame 240 disposed inside the handle case 230.

Referring to FIGS. 13 and 14, in an embodiment of the present disclosure, the gas inlet part 210 may be located farther from the body 100 than the fan unit 300, and the fan unit coupler 250 may include a noise reducer 260. The noise reducer 260 may be disposed between the fan unit 300 and the gas inlet part 210 to reduce noise of the fan unit 300 and gas.

The fan unit 300 may be disposed between the gas inlet part 210 and the body 100, and accordingly, gas flowing into the gas flow path 220 through the gas inlet part 210 may flow toward the fan unit 300, and the gas passing through the fan unit 300 may flow toward the body 100.

The gas inlet part 210 may be provided at an end of the handle 200 extending from the body 100, and the gas inlet part 210 may be provided on the inlet case 290 coupled to another end 232 of the handle case 230 with the one end 231 facing the body 100.

The fan unit 300 may be disposed closer to the body 100 than to the gas inlet part 210. The one end 241 of the fan unit coupler 250 may be coupled to the frame coupler 150 of the body extension 130, and the noise reducer 260 may be provided at the other end of the fan unit coupler 250.

The noise reducer 260 may be positioned between the fan unit 300 and the gas inlet part 210 in the fan unit coupler 250. In the fan unit 300, a fan may be provided at a position from the motor toward the gas inlet part 210.

That is, the fan unit coupler 250 is likely to generate vibration and noise at a side of the other end in which the fan of the fan unit 300 is located, and accordingly, in an embodiment of the present disclosure, the noise reducer 260 may be provided at the other end of the fan unit coupler 250, thereby effectively preventing noise caused by the fan unit 300 and a gas flow.

The noise reducer 260 may be provided in various ways to reduce noise. For example, the noise reducer 260 may include a sound absorber that absorbs and alleviates noise, or may be provided in an active manner using a piezoelectric element, and the like and may alleviate noise through a noise reduction space 262 surrounding the gas flow path 220.

In an embodiment of the present disclosure, the noise reducer 260 may be provided at a side of the other end in which gas is introduced toward the fan unit 300 and a turbulent flow behavior of gas is strengthened by the fan unit 300, and thus noise caused by the fan unit 300 and a gas flow may be effectively reduced.

Referring to FIGS. 13 and 14, in an embodiment of the present disclosure, the noise reducer 260 may include the noise reduction space 262 formed between an outer surface of the fan unit coupler 250 and the inner surface 221 of the handle case 230, and the noise reduction hole 264 formed in the fan unit coupler 250 to allow the noise reduction space 262 and the gas flow path 220 to communicate with each other.

In the noise reducer 260, an outer surface of the noise reducer 260, for example, an outer surface of the other end of the fan unit coupler 250 and the inner surface 221 of the handle case 230 may be spaced apart from each other to form a space, and the space may correspond to the noise reduction space 262.

A noise reduction groove that is recessed away from the handle case 230 and extends along a circumference of the fan unit coupler 250 may be formed on an outer surface of the noise reducer 260. The noise reduction groove may also be provided on the inner surface 221 of the handle case 230.

An outer surface of the noise reducer 260 and the inner surface 221 of the handle case 230 may be spaced apart from each other by the noise reduction groove to form the noise reduction space 262. The noise reduction space 262 itself may have an effect of preventing transmission of noise between the gas flow path 220 and the outside of the handle 200.

The noise reducer 260 may include a noise reduction hole 264 that allows the noise reduction space 262 and the gas flow path 220 to communicate with each other. The noise reduction hole 264 may be provided in the form of a hole penetrating the noise reducer 260 and may have various shapes.

The noise reducer 260 may be provided to allow the gas flow path 220 and the noise reduction space 262 to communicate with each other by the noise reduction hole 264, and the noise reduction space 262 communicates with the gas flow path 220 through the noise reduction hole 264 may act as a Helmholtz resonance organ.

That is, noise generated in the gas flow path 220 by driving of the fan unit 300 and a flow of gas in the gas flow path 220 may be transferred to the noise reduction space 262 through the noise reduction hole 264, and a specific frequency range of noise may be greatly reduced.

According to an embodiment of the present disclosure, noise generated by the fan unit 300 and a gas flow may be effectively reduced by using the noise reducer 260 including the noise reduction space 262 and the noise reduction hole 264.

According to an embodiment of the present disclosure, the hairdryer may include the gas inlet part 210 as described above, and the gas inlet part 210 may include the plurality of gas inlet holes 212 that are located farther from the body 100 than the fan unit 300, provided to surround an outer circumferential surface of the handle 200, and allow the gas flow path 220 to communicate with the outside.

FIGS. 3 and 13 schematically show the plurality of gas inlet holes 212 defining the gas inlet part 210 according to an embodiment of the present disclosure. The gas inlet part 210 may be provided in a grill shape including the plurality of gas inlet holes 212.

As shown in FIGS. 3 and 13, in an embodiment of the present disclosure, the handle 200 may further include the inlet case 290. The inlet case 290 may be coupled to the other end 232 of the handle case 230 coupled to the body 100 to define a part of an outer appearance of the handle 200, and may include the gas inlet part 210 formed therein.

Specifically, the handle case 230 and the inlet case 290 may extend in a longitudinal direction of the handle 200 to define the outer appearance of the handle 200 together. The one end 231 of the handle case 230 may face the body 100 and the other end 232 may face the inlet case 290.

One end of the inlet case 290 may face the handle case 230 and the other end may form an end of the handle 200. That is, one end of the inlet case 290 may be coupled to the other end 232 of the handle case 230.

The handle case 230 may have a pipe shape with both ends open, and the inlet case 290 may have a pipe shape with one end open and the other end closed.

A coupling method of the inlet case 290 and the handle case 230 may be various. For example, the inlet case 290 and the handle case 230 may be coupled in various methods, such as a hook and groove coupling method, a magnetic fastening method using a magnet, or a fastening method such as a bolt.

In an embodiment of the present disclosure, the inlet case 290 in which the gas inlet part 210 is provided may be manufactured separately from the handle case 230 and coupled to the handle case 230, thereby more easily improving molding of the gas inlet part 210 and a molding process of the handle 200.

In addition, the handle case 230 and the inlet case 290 may be provided together in a pipe shape, an assembly line parallel to a longitudinal direction of the handle 200 is excluded from each outer surface, and an assembly line of the handle case 230 and the inlet case 290 may be formed in parallel to a circumference direction of the handle 200, and thus it is difficult to visually identify the assembly line due to the outer appearance of the gas inlet part 210, and the appearance quality may be greatly improved.

Furthermore, a filter part may be provided inside the inlet case 290 to filter foreign substances in gas introduced through the gas inlet part 210, and according to an embodiment of the present disclosure, the inlet case 290 may be provided to be separated from the handle case 230, thereby effectively improving a replacement process of the filter part.

In an embodiment of the present disclosure, the handle case 230 may include the wire mounting part 270. The wire mounting part 270 may extend away from the body 100 in the fan unit coupler 250 and may be surrounded by the gas inlet part 210, and may contain the wire 107 therein extending from the body 100.

As described above, in an embodiment of the present disclosure, the wire 107 that is connected to the temperature adjuster 109, the controller 120, and the user part 125 and through which current flows may be provided, and the wire 107 may be extended from the inside of the body 100 through the communication hole 105, may extend along the inside of the handle 200, and may be extended to the outside through an end of the handle 200.

FIG. 8 shows the wire 107 extended from the inside of the body 100 through the communication hole 105, and FIG. 13 shows the wire 107 extending along the gas flow path 220.

The wire 107 may extend along the gas flow path 220, but at least a part thereof may be embedded in a wire mounting part 270.

The wire mounting part 270 may extend away from the body 100 from the fan unit coupler 250. That is, the wire mounting part 270 may extend from the other end of the fan unit coupler 250 toward the end surface of the handle 200. Accordingly, the wire mounting part 270 may be provided to be surrounded by the gas inlet part 210 provided to surround the outer surface of the handle 200.

The wire 107 extended from the body 100 may extend from the inside of the gas inlet part 210 to the inside of the wire mounting part 270 and be extended out of the handle 200. Accordingly, the wire 107 may be protected from a gas flow by the wire mounting part 270 inside the gas inlet part 210, in which gas flows and which has a strong turbulent flow, and noise caused by shaking due to the gas flow may be prevented.

In an embodiment of the present disclosure, the wire mounting part 270 may include a wire extractor 277 positioned at an end of the handle 200 to allow the wire 107 to be extended out of the handle 200. FIG. 13 or the like shows the wire 107 extended through the wire extractor 277, and FIG. 14 shows the wire extractor 277.

Referring to FIG. 14, the wire extractor 277 may be located at an end of the handle 200. That is, the wire 107 extended through the wire extractor 277 may pass through an end surface of the handle 200 and be extended out of the handle 200.

The shape of the wire extractor 277 may vary, and may be provided in a shape corresponding to a cross-sectional shape of the gas inlet part 210 or a shape of the end surface of the handle 200, and may be accommodated at the end of the handle 200.

Accordingly, in an embodiment of the present disclosure, the wire 107 extending from the body 100 is embedded in the wire mounting part 270, and thus noise caused by a gas flow or the like at the gas inlet part 210 may be prevented, and furthermore, the wire 107 embedded in the wire mounting part 270 may be stably extended through the end surface of the handle 200 by using the wire extractor 277.

In an embodiment of the present disclosure, the wire mounting part 270 may further include a wire extension 273. The wire extension 273 may extend from the fan unit coupler 250 and be connected to the wire extractor 277, and a wire space 274 in which the wire 107 is positioned may be formed therein.

FIG. 10 shows the wire extension 273 according to an embodiment of the present disclosure, FIG. 11 shows the inside of the wire extension 273 of FIG. 10, and FIG. 13 shows the wire 107 that extends along the wire extension 273 and extended out of the handle 200 through the wire extractor 277.

The wire extension 273 may extend from the fan unit coupler 250 toward an end of the handle 200. That is, the wire extension 273 may extend from the fan unit coupler 250 toward an end surface of the handle 200.

The wire extension 273 may define the wire space 274 in which the wire 107 is located. That is, the wire 107 extending along the gas flow path 220 may be retracted into the wire extension 273, extend along the wire space 274, and extended out of the handle 200 through the wire extractor 277.

The wire extension 273 may be disposed between the fan unit coupler 250 and the wire extractor 277 to connect the fan unit coupler 250 and the wire extractor 277. The shape of the wire extension 273 may be various.

In an embodiment of the present disclosure, the fan unit coupler 250 may have an end facing the gas inlet part 210, at which a fan opening 252 is formed, to supply gas to the fan unit 300, and the wire extension 273 is provided in a plate shape in which a through hole 275 is formed in the center, and the through hole 275 may be open toward the fan unit coupler 250 to be connected to the fan opening 252. FIG. 13 shows the wire extension 273 in which the fan opening 252 and the through hole 275 are formed.

The fan unit coupler 250 may be provided in a shape in which one end and the other end are open in a longitudinal direction of the handle 200. The fan unit coupler 250 may be provided in a pipe shape.

The fan opening 252 provided at the other end of the fan unit coupler 250 may be provided between the inside of the gas inlet part 210 and the fan unit 300. Gas introduced through the gas inlet part 210 may pass through the fan opening 252 and be provided to the fan unit 300.

The wire extension 273 is provided in a plate shape and a space in which gas introduced into the gas inlet part 210 flows from the inside the gas inlet part 210 toward the fan opening 252 may be ensured. In the present disclosure, the plate shape may correspond to various polygonal shapes such as a triangular shape and a pentagonal shape as well as a rectangular cross section.

The through hole 275 may be formed in the center of the wire extension 273 based on a cross section. As the through hole 275 is provided in the wire extension 273, interference with a gas flow inside the gas inlet part 210 may be minimized.

The shape of the through hole 275 may vary. In an embodiment of the present disclosure, the through hole 275 may have an extended shape to be connected to the fan opening 252. For example, as shown in FIG. 13, the through hole 275 may have a shape extending in a longitudinal direction of the handle 200.

That is, one end of the through hole 275, which faces the fan unit coupler 250, may extend to be open from the wire extension 273. The through hole 275 may have a shape in which a width increases to correspond to the width of the fan opening 252 toward one end of the wire extension 273.

According to an embodiment of the present disclosure, as the through hole 275 has an extended shape to be connected to the fan opening 252 in the wire extension 273, blockage of a flow of gas introduced through the gas inlet part 210 by the wire extension 273 inside the gas inlet part 210 may be effectively prevented.

Referring to FIG. 13, in an embodiment of the present disclosure, a wire retraction hole 279 for retracting the wire 107 thereinto may be formed at an end of the wire mounting part 270, which faces the fan unit coupler 250, a wire groove 254 for accommodating the wire 107 thereon may be formed on an outer surface of the fan unit coupler 250, and the wire 107 may be extended from the body 100, may extend along the wire groove 254, and may be retracted into the wire mounting part 270 through the wire retraction hole 279.

FIG. 10 shows the wire retraction hole 279 and the wire groove 254 viewed from the outside of the handle frame 240, and FIG. 11 shows the wire retraction hole 279 and the A wire groove 254 by exploding a plurality of split structures constituting the handle frame 240.

As described above, the wire 107 may be drawn from the inside of the body 100 toward the inside of the handle 200, that is, the gas flow path 220. The wire 107 may be retracted into the wire space 274 of the wire mounting part 270 through the wire retraction hole 279 while extending from the handle frame 240 along the wire groove 254.

The wire retraction hole 279 may be provided to allow the wire space 274 formed inside the wire mounting part 270 to communicate with the outside of the wire mounting part 270. That is, the wire retraction hole 279 may be provided in a form passing through one end of the wire extension 273, which faces the fan unit coupler 250.

The wire retraction hole 279 may extend from the wire space 274 and pass through an outer surface of the wire mounting part 270. Accordingly, the wire 107 extending along the outer surface of the fan unit coupler 250 may enter the wire space 274 through the wire retraction hole 279.

The wire groove 254 may be formed on an outer surface of the fan unit coupler 250. The wire groove 254 may have a shape recessed in the outer surface of the fan unit coupler 250 and may have a shape extending in the longitudinal direction of the handle 200.

Accordingly, the wire 107 extending from the body 100 may be blocked from contacting the fan unit 300, gas passing through the fan unit 300 may be prevented from interfering with the wire 107, and at the same time, the wire 107 may stably extend from the one end 241 of the handle frame 240 to the other end.

A wire passage hole 134 that faces the wire groove 254 and through which the wire 107 passes may be formed at the other end 132 of the body extension 130, and the wire 107 may pass through the wire passage hole 134 and extend along the wire groove 254. FIG. 12 shows the wire passage hole 134 formed at the other end 132 of the body extension 130 according to an embodiment of the present disclosure.

As described above, the frame coupler 150 to which the handle frame 240 is coupled may protrude from the end surface 133 of the body extension 130 toward the handle frame 240, and the end surface 133 of the body extension 130 and an end surface of the handle frame 240 may be arranged to face each other.

The wire groove 254 formed on the outer surface of the frame coupler 150 may be provided in an open form toward the body extension 130 of the handle frame 240, and the wire passage hole 134 of the body extension 130 may be arranged to face the wire groove 254.

Accordingly, the wire 107 extended from the body 100 to the inside of the handle 200 through the communication hole 105 of the body case 101 may pass through the wire passage hole 134 of the body extension 130 and may be retracted into the wire groove 254 of the fan unit coupler 250, and the wire 107 passing through the wire groove 254 may be retracted into the wire mounting part 270 through the wire retraction hole 279.

According to an embodiment of the present disclosure, the wire 107 extending from the body 100 may be stably protected from interfering with a gas flow or the fan unit 300 by using the body extension 130 and the handle frame 240.

In an embodiment of the present disclosure, the fan unit 300 may be coupled to the handle frame 240 and fixed on the gas flow path 220 while being spaced apart from the inner surface 221 of the handle case 230.

According to an embodiment of the present disclosure, since the fan unit 300 is spaced apart from the inner surface 221 of the handle case 230, vibration or the like generated from the fan unit 300 may not be directly transmitted to the handle case 230, thereby effectively preventing vibration and noise from being transferred to a user.

Although the present disclosure has been shown and described in relation to a specific embodiment, it will be obvious to those skilled in the art that the present disclosure is variously modified and changed within the scope of not departing from the technical spirit of the present disclosure provided by the claims below.

The invention claimed is:

1. A hairdryer comprising:

a body including a gas discharge part through which gas is discharged; and a handle connected to the body and including a gas inlet part into which gas is introduced and a gas flow path extending from the gas inlet part to the body, wherein the body includes a body extension extending toward an inside of the gas flow path; and wherein the handle includes:

a handle case defining at least a part of an outer appearance of the handle, the body extension being inserted into the gas flow path formed in the handle case;

a fan unit provided on the gas flow path and configured to fluidize gas; and a handle frame provided on the gas flow path, coupled to the body extension, and coupled to the fan unit to fix the fan unit, wherein the body extension includes a frame coupler having an end facing the body and a remaining end to which the handle frame is coupled; and the handle frame has an end facing the body extension, which is coupled to the frame coupler and fixed on the gas flow path.

2. The hairdryer of claim 1, wherein:

the body includes a communication hole communicating with the gas flow path; and the body extension extends from a circumference portion of the communication hole and has a space defining a part of the gas flow path therein.

3. The hairdryer of claim 2, wherein:

the body extension includes an accommodator on which a manipulator configured to provide information to a user or receive information is accommodated; and the handle case has an open position corresponding to the accommodator to expose the manipulator to an outside.

4. The hairdryer of claim 3, wherein the body extension further includes a first sealer extending along at least a part of a circumference of the accommodator and preventing gas from leaking to an outside through the accommodator.

5. The hairdryer of claim 4, wherein the body extension further includes a second sealer surrounding an end of the body extension, which faces the body, and preventing a gas flow between the end and an inner surface of the handle case.

6. The hairdryer of claim 5, wherein the body extension further incudes a third sealer surrounding a remaining end of the body extension and preventing a gas flow between the remaining end and the inner surface of the handle case.

7. The hairdryer of claim 1, wherein:

the body includes a body case defining an outer appearance; and the body extension is integrally molded with the body case.

8. The hairdryer of claim 1, wherein the handle case is molded in a pipe shape and coupled to the body to allow the body extension to be inserted thereinto.

9. The hairdryer of claim 1, wherein the handle frame includes a fan unit coupler surrounding an outer circumferential surface of the fan unit to fix the fan unit therein and coupled to the frame coupler.

10. The hairdryer of claim 9, wherein the frame coupler includes a vibration isolation member provided between the frame coupler and the fan unit coupler and preventing transmission of vibration of the fan unit.

11. The hairdryer of claim 10, wherein:

the frame coupler protrudes toward the handle frame from an end surface of the remaining end of the body extension; and the vibration isolation member is provided on the end surface and blocks contact between the end surface and the handle frame.

12. The hairdryer of claim 9, wherein:

the gas inlet part is located farther from the body than the fan unit; and the fan unit coupler includes a noise reducer positioned between the fan unit and the gas inlet part and reducing noise of the fan unit and gas.

13. The hairdryer of claim 12, wherein the noise reducer includes a noise reduction space formed between an outer surface of the fan unit coupler and an inner surface of the handle case, and a noise reduction hole formed in the fan unit coupler to allow the noise reduction space and the gas flow path to communicate with each other.

14. The hairdryer of claim 9, wherein the gas inlet part includes a plurality of gas inlet holes located farther from the body than the fan unit, formed in an outer circumferential surface of the handle, and allowing the gas flow path to communicate with an outside.

15. The hairdryer of claim 14, wherein the handle further includes an inlet case coupled to a remaining end of the handle case having an end coupled to the body, defining a part of an outer appearance of the handle, and including the gas inlet part.

16. The hairdryer of claim 14, wherein the handle case includes a wire mounting part extending away from the body in the fan unit coupler, positioned to be surrounded by the gas inlet part, and embedding a wire extending from the body therein.

17. The hairdryer of claim 16, wherein the wire mounting part includes a wire extractor that is positioned at an end of the handle and through which the wire is extended out of the handle.

18. The hairdryer of claim 17, wherein the wire mounting part includes a wire extension that extends from the fan unit coupler to be connected to the wire extractor and in which a wire space with the wire position therein is formed.

19. The hairdryer of claim 18, wherein:

the fan unit coupler has an end facing the gas inlet part, at which a fan opening is formed, to supply gas to the fan unit; and the wire extension is provided in a plate shape in which a through hole is formed in a center and extends in a longitudinal direction of the handle, and the through hole is open toward the fan unit coupler to be connected to the fan opening.

20. The hairdryer of claim 16, wherein:

the wire mounting part has an end facing the fan unit coupler, at which a wire retraction hole for retracting the wire is formed;

the fan unit coupler has an outer surface on which a wire groove with the wire accommodated thereon is formed; and the wire is extended from the body, extends along the wire groove, and is retracted into the wire mounting part through the wire retraction hole.

21. The hairdryer of claim 20, wherein:

a wire passage hole that faces the wire groove and through which the wire passes is formed at the remaining end of the body extension; and the wire passes through the wire passage hole and extends along the wire groove.

22. A hairdryer comprising:

a body including a gas discharge part through which gas is discharged; and a handle extending from the body and including a gas inlet part into which gas is introduced and a gas flow path extending from the gas inlet part to the body, wherein the body includes a body extension extending toward an inside of the gas flow path; and wherein the handle includes:

a handle case defining at least a part of an outer appearance of the handle, the body extension being inserted into the gas flow path formed in the handle case;

a handle frame provided on the gas flow path and coupled to the body extension; and a fan unit coupled to the handle frame and fixed on the gas flow path while being spaced apart from an inner surface of the handle case, wherein the body extension includes a frame coupler having an end facing the body and a remaining end to which the handle frame is coupled; and the handle frame has an end facing the body extension, which is coupled to the frame coupler and fixed on the gas flow path.

* * * * *